US008051610B2

(12) United States Patent
Chance

(10) Patent No.: US 8,051,610 B2
(45) Date of Patent: Nov. 8, 2011

(54) PATIENT FLATWALL SYSTEM

(75) Inventor: Richard W. Chance, Greenwood, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 1098 days.

(21) Appl. No.: 11/210,012

(22) Filed: Aug. 23, 2005

(65) Prior Publication Data

US 2006/0073713 A1 Apr. 6, 2006

Related U.S. Application Data

(60) Provisional application No. 60/611,958, filed on Sep. 22, 2004.

(51) Int. Cl.
*E04H 3/08* (2006.01)
*A47B 23/04* (2006.01)

(52) U.S. Cl. ..... 52/36.1; 52/39; 52/29; 5/601; 248/324; 248/284.1; 248/610

(58) Field of Classification Search ..... 52/39, 29, 52/27, 36.1; 5/658, 503.1, 601, 600; 248/324, 248/282.1, 284.1, 610
See application file for complete search history.

(56) References Cited

U.S. PATENT DOCUMENTS

| | | | | |
|---|---|---|---|---|
| 860,303 | A | | 7/1907 | Jones |
| 1,686,341 | A | | 10/1928 | Nathanson |
| 1,915,985 | A | | 6/1933 | Edwards |
| 2,208,945 | A | | 7/1940 | Miller |
| 2,439,009 | A | | 4/1948 | Kujawski |
| 2,547,532 | A | | 4/1951 | Mendelsohn |
| 2,607,881 | A | | 8/1952 | Anderson |
| 2,998,508 | A | | 8/1961 | Bobrick |
| 3,012,781 | A | | 12/1961 | Nelson |
| 3,030,128 | A | | 4/1962 | Versen |
| 3,112,968 | A | | 12/1963 | Cotton et al. |
| 3,213,877 | A | | 10/1965 | May et al. |
| 3,243,497 | A | | 3/1966 | Kendall et al. |
| 3,272,928 | A | | 9/1966 | Hainzelin |
| 3,281,598 | A | * | 10/1966 | Hollstein ..... 378/179 |
| 3,358,957 | A | | 12/1967 | Lindenmuth |
| 3,373,285 | A | * | 3/1968 | Barrett ..... 378/194 |
| 3,430,997 | A | | 3/1969 | Propst et al. |
| 3,431,937 | A | | 3/1969 | Hettlinger et al. |
| 3,462,892 | A | | 8/1969 | Meyer |
| 3,556,455 | A | * | 1/1971 | Fred et al. ..... 248/333 |
| 3,567,842 | A | | 3/1971 | Meyer |
| 3,599,922 | A | * | 8/1971 | Junginger ..... 248/313 |
| 3,609,211 | A | | 9/1971 | Van Herk |
| 3,660,591 | A | * | 5/1972 | Schultz et al. ..... 174/70 R |

(Continued)

FOREIGN PATENT DOCUMENTS

DE 92 04 321.6 5/1992

(Continued)

*Primary Examiner* — Phi Dieu Tran A
(74) *Attorney, Agent, or Firm* — Barnes & Thornburg LLP

(57) ABSTRACT

A patient flatwall system comprises a generally horizontal track extending generally parallel and adjacent to a wall of a hospital room, and at least one patient flatwall coupled to the track for movement therealong and for rotational movement relative thereto about a generally vertical axis. The at least one flatwall has a plurality of service connectors. In another embodiment, a patient flatwall system comprises a short telescopic arm having a proximal end coupled to the track for movement therealong, and a patient flatwall coupled to a distal end of the telescopic arm for rotational movement about a generally vertical axis.

25 Claims, 2 Drawing Sheets

U.S. PATENT DOCUMENTS 3,662,981 A 5/1972 Hogrebe
D226,353 S 2/1973 Schultz et al.
3,742,674 A * 7/1973 Lang ..... 52/666
3,757,363 A 9/1973 Langlais
3,769,502 A 10/1973 Schultz et al.
3,794,395 A 2/1974 Damico et al.
3,820,752 A 6/1974 Oram
3,889,914 A 6/1975 Torme
3,977,645 A 8/1976 Deely
4,023,757 A 5/1977 Allard et al.
4,032,775 A 6/1977 Bobrick et al.
4,080,530 A 3/1978 Krogsrud
4,094,484 A 6/1978 Galione
4,104,710 A 8/1978 Damico et al.
4,107,769 A 8/1978 Saluja
4,155,609 A 5/1979 Skafte et al.
4,160,536 A 7/1979 Krogsrud
4,165,530 A 8/1979 Sowden
4,166,602 A 9/1979 Nilsen et al.
4,183,489 A 1/1980 Copher et al.
4,203,368 A * 5/1980 Haskins ..... 104/92
4,208,028 A 6/1980 Brown et al.
4,266,747 A 5/1981 Souder, Jr. et al.
D261,804 S 11/1981 Foster et al.
4,338,485 A 7/1982 Fullenkamp et al.
4,353,411 A 10/1982 Harter et al.
4,410,158 A 10/1983 Maffei
4,452,499 A 6/1984 Verburg
4,453,687 A 6/1984 Sweere
4,453,695 A 6/1984 Sennott et al.
4,465,255 A 8/1984 Hill
4,475,322 A 10/1984 Russo et al.
4,494,177 A 1/1985 Matthews
4,523,683 A 6/1985 Fullenkamp et al.
4,523,732 A 6/1985 Biber et al.
4,562,987 A 1/1986 Leeds et al.
4,589,557 A 5/1986 Bollmann
4,591,124 A 5/1986 Hellenbrand et al.
4,610,118 A 9/1986 Fullenkamp
4,646,211 A 2/1987 Gallant et al.
4,662,524 A 5/1987 Fullenkamp et al.
4,677,273 A * 6/1987 Colegrove et al. ..... 219/121.13
4,687,167 A 8/1987 Skalka et al.
4,720,768 A 1/1988 Schindele
4,725,030 A 2/1988 Miller et al.
4,744,019 A 5/1988 Krogsrud
4,753,055 A 6/1988 Durham, Jr.
4,770,384 A 9/1988 Kuwazima et al.
4,795,122 A 1/1989 Petre
4,801,815 A 1/1989 Biette et al.
4,817,903 A 4/1989 Braehler et al.
4,821,470 A 4/1989 Kappers et al.
4,836,478 A 6/1989 Sweere
4,844,387 A 7/1989 Sorgi et al.
4,846,434 A 7/1989 Krogsrud
D302,502 S 8/1989 Durham, Jr.
D303,743 S 10/1989 Durham, Jr.
D303,889 S 10/1989 Durham, Jr.
4,879,798 A 11/1989 Petre
4,901,967 A 2/1990 Petre
4,905,433 A 3/1990 Miller
4,945,592 A 8/1990 Sims et al.
4,989,253 A * 1/1991 Liang et al. ..... 381/110
4,993,683 A 2/1991 Kreuzer
4,997,155 A 3/1991 Reuter et al.
5,026,017 A 6/1991 Kreuzer
5,060,425 A 10/1991 Kappers et al.
5,072,906 A 12/1991 Foster
5,077,843 A 1/1992 Dale et al.
5,100,091 A 3/1992 Pollak
5,107,636 A 4/1992 Schindele et al.
5,108,063 A 4/1992 Koerber, Sr. et al.
5,108,064 A 4/1992 Kreuzer
5,113,897 A 5/1992 Kummerfeld et al.
5,186,337 A 2/1993 Foster et al.
5,277,005 A 1/1994 Hellwig et al.
5,284,255 A 2/1994 Foster et al.
5,288,277 A 2/1994 Kummerfeld
5,299,338 A 4/1994 Foster
5,306,109 A 4/1994 Kreuzer et al.
5,323,565 A 6/1994 Kappers et al.
5,333,103 A 7/1994 Cvek
5,340,072 A 8/1994 Halbirt
5,348,260 A 9/1994 Acevedo
5,377,371 A 1/1995 Foster
5,396,673 A 3/1995 Foster
5,397,323 A * 3/1995 Taylor et al. ..... 606/130
5,398,359 A 3/1995 Foster
5,421,548 A 6/1995 Bennett et al.
5,448,859 A 9/1995 Walker et al.
5,452,807 A 9/1995 Foster et al.
5,455,975 A * 10/1995 Foster ..... 5/600
5,456,655 A 10/1995 Morris
5,475,730 A * 12/1995 Galando ..... 378/157
5,479,958 A 1/1996 Kummerfeld
5,513,574 A 5/1996 Collins
5,597,385 A 1/1997 Moerke
5,603,496 A 2/1997 Rappaport
5,618,090 A 4/1997 Montague et al.
5,644,876 A 7/1997 Walker
5,647,491 A 7/1997 Foster et al.
5,653,064 A 8/1997 Kappers et al.
5,738,316 A 4/1998 Sweere et al.
5,743,503 A 4/1998 Voeller et al.
5,756,933 A 5/1998 Pitchford et al.
5,778,612 A 7/1998 Kissinger et al.
5,799,917 A 9/1998 Li
5,826,846 A 10/1998 Buccieri et al.
5,842,672 A 12/1998 Sweere et al.
5,876,008 A 3/1999 Sweere et al.
5,878,536 A 3/1999 Demmitt et al.
5,884,661 A 3/1999 Plyler et al.
5,890,326 A 4/1999 Gallant et al.
5,895,886 A 4/1999 Beuster et al.
5,911,661 A 6/1999 Murray et al.
D412,161 S 7/1999 Theis et al.
5,924,665 A 7/1999 Sweere et al.
D413,110 S 8/1999 Sweere et al.
5,947,429 A 9/1999 Sweere et al.
5,966,760 A 10/1999 Gallant et al.
5,967,479 A 10/1999 Sweere et al.
5,992,809 A 11/1999 Sweere et al.
D418,603 S 1/2000 Gallant
6,045,596 A 4/2000 Holland, Jr. et al.
6,088,980 A 7/2000 Gulliver
6,095,468 A 8/2000 Chirico et al.
6,096,025 A * 8/2000 Borders ..... 606/1
D434,502 S 11/2000 Gallant
6,145,254 A 11/2000 Silva
6,146,158 A 11/2000 Peratoner et al.
6,152,426 A 11/2000 Von Fange
6,155,743 A 12/2000 Chen
6,170,102 B1 1/2001 Kreuzer
6,179,260 B1 1/2001 Ohanian
6,201,983 B1 3/2001 Haumann et al.
6,213,481 B1 4/2001 Marchese et al.
6,231,526 B1 5/2001 Taylor et al.
D443,365 S 6/2001 Walker
6,256,935 B1 7/2001 Walker
6,269,594 B1 8/2001 Walker
D452,573 S 12/2001 Walker
6,343,601 B1 2/2002 Kiske et al.
6,349,436 B1 2/2002 Kreuzer
6,405,491 B1 6/2002 Gallant
6,431,515 B1 8/2002 Gampe et al.
6,434,329 B1 * 8/2002 Dube et al. ..... 396/14
6,553,587 B1 4/2003 Barker et al.
6,668,493 B1 12/2003 Walker
6,725,483 B2 4/2004 Gallant et al.
6,851,853 B2 * 2/2005 Nakagawa et al. ..... 378/197
6,895,715 B2 5/2005 Gallant et al.
7,065,811 B2 * 6/2006 Newkirk et al. ..... 5/600
7,065,812 B2 * 6/2006 Newkirk et al. ..... 5/600
7,216,382 B2 * 5/2007 Newkirk et al. ..... 5/600
7,254,850 B2 * 8/2007 Newkirk et al. ..... 5/600

| | | | | |
|---|---|---|---|---|
| 2003/0014817 | A1 * | 1/2003 | Gallant et al. | 5/600 |
| 2004/0040086 | A1 | 3/2004 | Eisenberg et al. | |
| 2004/0237202 | A1 | 12/2004 | Gallant et al. | |

FOREIGN PATENT DOCUMENTS

| | | | |
|---|---|---|---|
| EP | 0 215 212 | A | 3/1987 |
| EP | 0 257 299 | A | 3/1988 |
| EP | 0 943 306 | B1 | 9/1999 |
| EP | 1 243 900 | A3 | 9/2002 |
| FR | 1292174 | A | 3/1987 |
| GB | 1 061 383 | | 3/1967 |
| WO | WO 00/09061 | | 2/2000 |
| WO | WO 2004/082553 | A2 | 9/2004 |

* cited by examiner

PATIENT FLATWALL SYSTEM

CROSS REFERENCE TO RELATED APPLICATION

This application claims the benefit of U.S. Provisional Patent Application Ser. No. 60/611,958, filed on Sep. 22, 2004, and entitled "Patient Flatwall System," which is hereby incorporated by reference herein.

BACKGROUND OF THE INVENTION

The present disclosure relates to a system for supporting patient care equipment, such as infusion pumps, heart monitors, defibrillators, service connectors, etc., in a hospital room adjacent a patient support, such as a hospital bed, stretcher, chair or the like.

Hospitalized patients often require patient care equipment to be in close proximity during their hospital stay. Such patient care equipment may include any one or more of the following: service connectors, infusion pumps, heart monitors, defibrillators, equipment monitors, and the like, many of which directly connect to the patient via lines or tubes. Some of the service connectors may be electrical power outlets to supply electrical power. Some of the service connectors may be medical gas connectors to provide medical gases, such as oxygen, nitrogen, and air. Some of the service connectors may be negative pressure connectors to supply vacuum. Some of the service connectors may be data communication ports to receive and transmit data, such as, for example, audio, video, and patient information.

BRIEF SUMMARY OF THE INVENTION

The present invention comprises a system that has one or more of the following features or combinations thereof, which alone or in any combination may comprise patentable subject matter:

A patient flatwall system may comprise a generally horizontal track extending generally parallel and adjacent to a wall of a hospital room, and at least one patient flatwall coupled to the track for movement therealong and for rotational movement relative thereto about a generally vertical axis. At least one flatwall may have a plurality of service connectors. The wall of the hospital room may comprise a wall located adjacent a head end of a patient support, such as a hospital bed.

At least one flatwall may be rotatable through 180° about the vertical axis in both clockwise and anticlockwise directions. The track is sufficiently spaced apart from the wall to allow rotation of the flatwall about the vertical axis.

At least one flatwall may include a front having the plurality of service connectors. At least one flatwall may be rotatable between a use position where the service connectors are facing outwardly to permit access to the service connectors and a storage position where the service connectors are facing inwardly to deny access to the service connectors.

At least one flatwall may include a back having an aesthetically pleasing surface or a screen for projecting images. Alternately, at least one flatwall may include a front and a back, each having a plurality of service connectors.

At least one flatwall may comprise first and second flatwalls coupled to the track for movement therealong, and for rotational movement about respective generally vertical axes.

The plurality of service connectors may include any one or more of the following: medical gas connectors, air connectors, negative pressure connectors, electrical power outlets, data ports, and the like.

At least one flatwall may include a plurality of patient care units. The plurality of patient care units may include any one or more of the following: infusion pumps, heart monitors, defibrillators, equipment monitors, and the like, many of which directly connect to the patient via lines or tubes.

A patient flatwall system may comprise a short arm having a proximal end coupled to the track for movement therealong, and a patient flatwall coupled to a distal end of the arm for rotational movement about a generally vertical axis.

The arm may be telescopic. The telescopic arm may include a first segment and a second segment that is movable relative to the first segment between an extended position and a retracted position. Alternately, the arm may be non-telescopic. The non-telescopic arm may be rotatable in a horizontal plane about a generally vertical axis extending through a proximal end thereof between an extended position and a retracted position.

The track and the arm may include interior passageways through which a plurality of service lines may be routed for connection to the associated patient care equipment and the service connectors carried by the flatwall.

Additional features, which alone or in combination with any other feature(s), such as those listed above and those listed in the appended claims, may comprise patentable subject matter and will become apparent to those skilled in the art upon consideration of the following detailed description of illustrative embodiments exemplifying the best mode of carrying out the embodiments as presently perceived.

BRIEF DESCRIPTION OF THE DRAWINGS

The detailed description particularly refers to the accompanying figures, in which.

DETAILED DESCRIPTION OF THE ILLUSTRATIVE EMBODIMENTS

Figure 1:
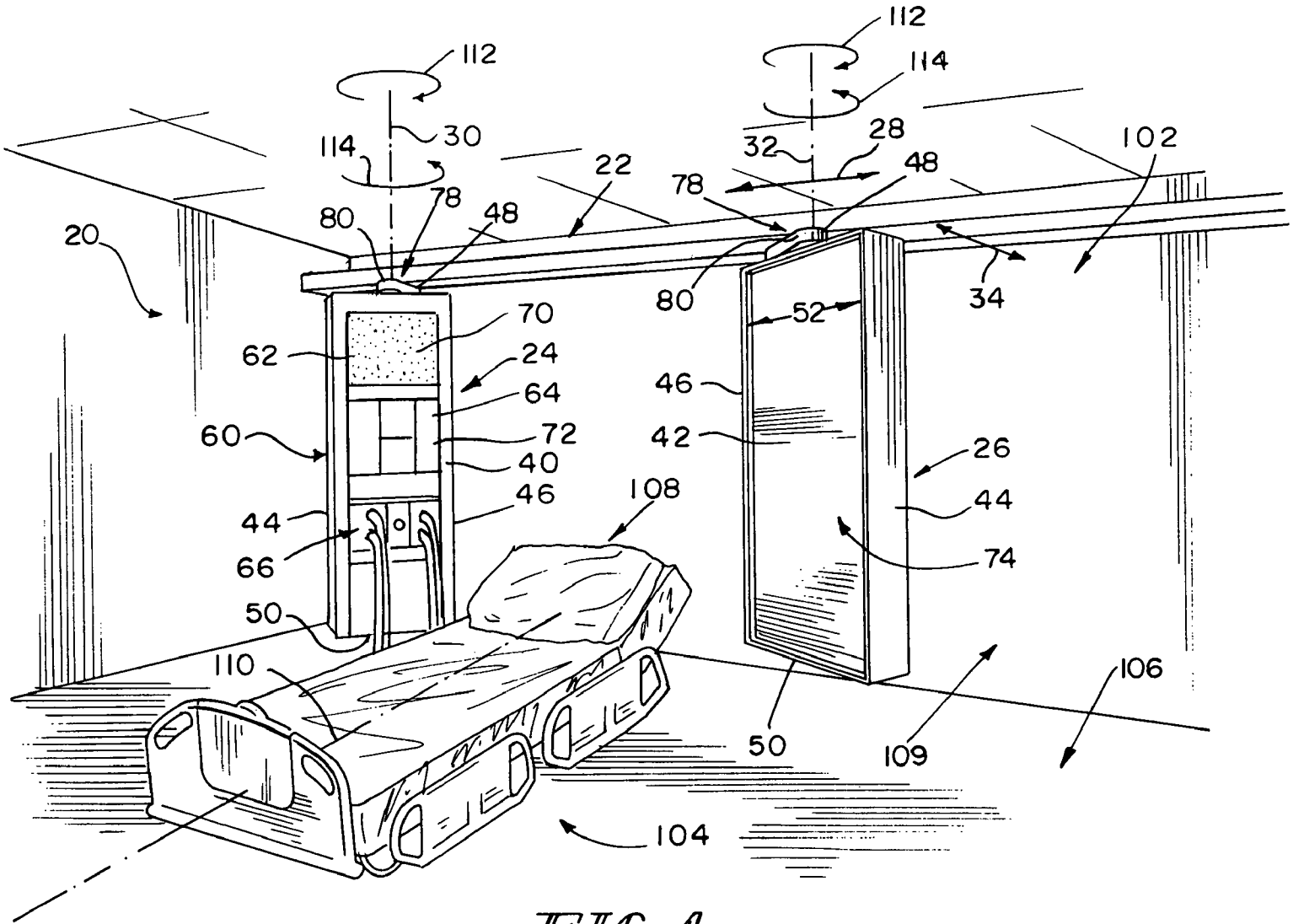
FIG. 1 is a perspective view of a patient flatwall system showing a generally horizontal track extending generally parallel and adjacent to a wall of a hospital room, and first and second patient flatwalls coupled to the track for movement therealong and for rotational movement relative thereto about respective generally vertical axes, and further showing one flatwall having a plurality of service connectors facing toward a hospital bed, and the other flatwall having a plurality of service connectors facing away from the hospital bed.

Referring to FIG. 1, a patient flatwall system 20 comprises a generally horizontal track 22 extending generally parallel to and adjacent a wall 100 of a hospital room 102. A pair of patient flatwalls 24, 26 are coupled to the track 22 for side-to-side movement along a laterally-extending axis 28, and for rotational movement relative thereto about respective generally vertical axes 30, 32. Each flat wall 24, 26 includes a front wall 40, a back wall 42, side walls 44, 46, a top wall 48, and a bottom wall 50. Each flatwall 24, 26 is configured to support patient care equipment 60, such as a monitor 62, infusion pumps 64, and a plurality of service connectors 66. The term "flatwall" is used in a general sense to mean an elongated box-shaped unit configured to carry patient care equipment, and having generally flat front, back, side, top and bottom surfaces and having a depth smaller than a width.

Each flatwall 24, 26 may be configured to support additional patient care equipment 60, such as, for example, heart monitors, defibrillators, and the like. Some of the service connectors 66 may be electrical power outlets to supply electrical power. Some of the service connectors 66 may be medical gas connectors to provide medical gases, such as, for example, any one or more of oxygen, nitrogen, and air. Some of the service connectors 66 may be negative pressure connectors to supply vacuum. Some of the service connectors 66 may be data communication ports to receive and transmit data, such as, for example, any one or more of audio, video, and information.

As shown, the monitor 62, the infusion pumps 64, and the plurality of service connectors 66 are all accessible from the front wall 40 of the respective flatwall 24, 26. A front wall 70 of the monitor 62 and front walls 72 of the infusion pumps 64 are generally flush with the front wall 40 of the associated flatwall 24, 26. In the illustrated embodiment, the back wall 42 of each flatwall 24, 26 has a screen 74 for projecting images, such as, for example, television pictures. If the back wall 42 of the flatwall 24, 26 is configured to project television pictures, the associated flatwall 24, 26 may include speakers (not shown) for the sound accompaniment. Alternately, the back wall 42 of each flatwall 24, 26 may have an aesthetically pleasing surface, such as, for example, a painting.

A patient support, such as a hospital bed 104, is supported on a floor 106 of the hospital room 102 such that a head end 108 of the bed 104 is near the wall 100, and a longitudinal axis 110 of the bed 104 is generally perpendicular to the wall 100. The flatwalls 24, 26 may be located on either side of the bed 104. In the illustrated embodiment, each flatwall 24, 26 is rotatable through at least 90° about the associated vertical axis 30, 32. The track 22 is sufficiently spaced apart from the wall 100 to allow the rotation of the flatwalls 24, 26 about the respective axes 30, 32. The ability to rotate the flatwall 24, 26 through 90° allows the flatwall 24, 26 to be located between two hospital beds (not shown) arranged side-by-side in the hospital room 102 such that the flatwall 24, 26 may be oriented generally perpendicularly to the wall 100 to provide a measure of privacy to the two patients occupying the side-by-side beds. This feature allows the hospital room 102 to double as a private room for one patient or a semi-private room for two patients. In some embodiments, the flatwall 24, 26 may have patient care equipment 60 on both the front wall 40 and the back wall 42. In such embodiments, the flatwall 24, 26 may be located between two adjacent hospital beds and turned 90° to provide patient care services to the two patients lying on the adjacent beds on the opposite sides of the flatwall 24, 26.

In the illustrated embodiment, each flatwall 24, 26 is rotatable through 360° about the associated vertical axis 30, 32 in both clockwise and anticlockwise directions 112, 114. A distance 34 between centerline of the track 22 and the wall 100 is greater than one half the width 52 of the flatwall 24, 26 to allow the flatwall 24, 26 to rotate through 360°. Each flatwall 24, 26 is rotatable between a use position where the front wall 40 of the associated flatwall 24, 26 having the patient care equipment 60 is facing outwardly, and a storage position where the back wall 42 of the associated flatwall 24, 26 having the screen 74 or the aesthetically pleasing surface is facing outwardly. This feature permits the hospital room 102 to double as a medical/surgical room or a progressive care room.

Illustratively, each flatwall 24, 26 includes a carriage or a slider 78 which is configured to move along the track 22. A shaft 80 extends downwardly from each carriage for supporting the associated flatwall 24, 26 for rotation about the respective axes 30, 32. The carriage 78 may be mounted on guide rails, rollers, linear bearings, ball bearings, roller bearings, hydraulic bearings, air bearings, and the like, for movement relative to the track 22. In some alternative embodiments, drive mechanisms and controls (not shown) may be provided for moving the respective carriages 78 along the track 22 and for turning the flatwalls 24, 26 about the associated axes 30, 32.

The track 22 and the shafts 80 include interior passageways through which a plurality of service lines are routed for connection to the associated patient care equipment 60 and the service connectors 66 carried by the respective flatwalls 24, 26. The service lines may extend from equipment located remotely from the hospital room 102 to the associated patient care equipment 60 and the service connectors 66.

Energy chain management system may be employed to guide the service lines through the track 22 and through the shafts 80 to prevent their entanglement with each other or other objects while permitting movement of the flatwalls 24, 26 along the track 22 and about the respective axes 30, 32. Such energy chain management systems are commercially available through Igus Inc. of East Providence, R.I., and are marketed under the trademark E-Chain.

Figure 2:
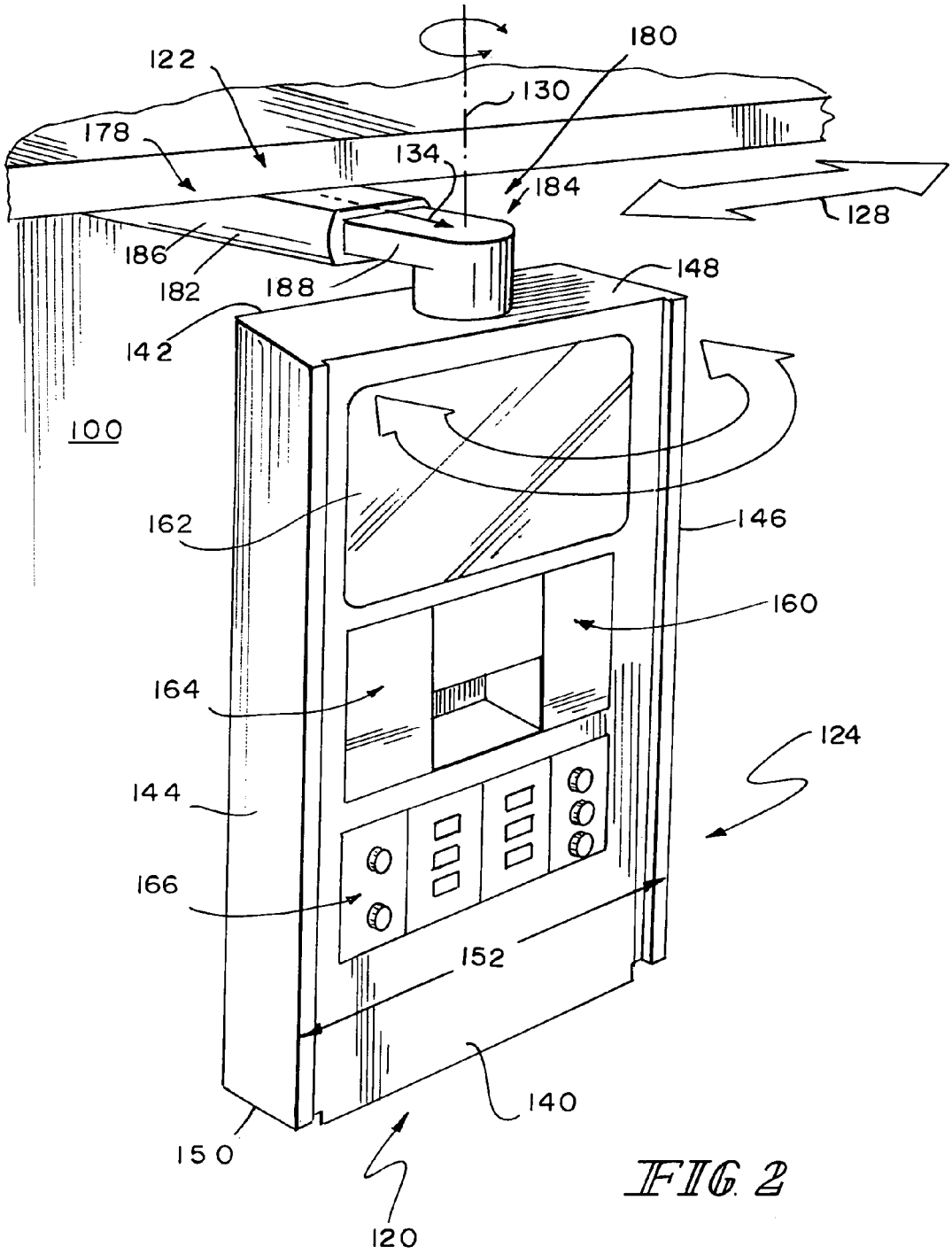
FIG. 2 is a perspective view similar to FIG. 1 of a second embodiment of the patient flatwall system showing a short telescopic arm having a proximal end coupled to the track for movement therealong, and a patient flatwall coupled to a distal end of the arm for rotational movement about a generally vertical axis.

FIG. 2 illustrates a second embodiment of the patient flatwall system 20. Like elements of the two embodiments have generally similar reference numbers. Thus, in the second embodiment, numeral 120 designates the patient flatwall system, numeral 122 designates the track, and numeral 124 designates the patient flatwall. The flatwall 124 includes a front wall 140, a back wall 142, side walls 144, 146, a top wall 148, and a bottom wall 150. The flatwall 124 is configured to support patient care equipment 160, such as a monitor 162, infusion pumps 164, and a plurality of service connectors 166. The flatwall system 120 includes a short cantilevered arm 180 having a proximal end 182 coupled to a carriage or a slider 178 which is movable along the track 122 in a laterally-extending direction 128. The short arm 180 extends generally horizontally and outwardly from the track 122. The track 122 extends generally parallel and adjacent to the wall 100. The flatwall 124 is coupled to a distal end 184 of the arm 180 for rotational movement about a generally vertical axis 130.

The carriage 178 may be mounted on guide rails, rollers, linear bearings, ball bearings, roller bearings, hydraulic bearings, air bearings, and the like, for movement relative to the track 122. In some alternative embodiments, drive mechanism and control (not shown) may be provided for moving the carriage 178 along the track 122 and for turning the flatwall 124 about the associated axis 130.

In some embodiments, the flatwall 124 is coupled to a cantilevered arm supported by a ceiling or a wall of the patient room 102. The cantilevered arm may be either telescopic or non-telescopic. Alternately, the cantilevered arm may be supported by a support structure that extends upwardly from a floor of the patient room 102.

The arm 180 includes an outer tube 186 and an inner tube 188 that telescopes horizontally into and out of the outer tube 186. The proximal end 182 of the outer tube 186 is coupled to the carriage 178 for lateral movement. A shaft (not shown) extends downwardly from the distal end 184 of the inner tube 188. The flatwall 124 is coupled to the shaft for rotation about the vertical axis 130. The inner tube 188 telescopes between an extended position permitting rotation of the flatwall 124 about the vertical axis 130, and a retracted position not permitting the rotation of the flatwall 124 about the vertical axis 130. The displacement of the inner tube 188 relative to the outer tube 186 is such that the maximum distance 134 between the rotational axis 130 of the flatwall 124 and the wall 100 is slightly greater than one half the width 152 of the flatwall 124 to allow the flatwall 124 to rotate through 360° about the axis 130. In some embodiments, the telescoping arm 124 may be rotatable in a horizontal plane about a generally vertical axis (not shown) extending through the proximal end 182 of the outer tube 186.

In the illustrated embodiment, the track 122 and the telescopic arm 180 include interior passageways through which a plurality of service lines are routed for connection to the associated patient care equipment 160 and the service connectors 166 carried by the flatwalls 124.

While the disclosure is susceptible to various modifications and alternative forms, specific exemplary embodiments thereof have been shown by way of example in the drawings and have herein been described in detail. It should be understood, however, that there is no intent to limit the disclosure to the particular forms disclosed, but on the contrary, the intention is to cover all modifications, equivalents, and alternatives falling within the spirit and scope of the disclosure as defined by the appended claims.

There is a plurality of advantages of the present invention arising from the various features of the embodiments described herein. It will be noted that alternative embodiments of the present invention may not include all of the features described yet still benefit from at least some of the advantages of such features. Those of ordinary skill in the art may readily devise their own implementations of a device that incorporates one or more of the features of the present invention and fall within the spirit and scope of the present invention as defined by the appended claims.

The invention claimed is:

1. A patient flatwall system for use in a hospital room having a wall, the flatwall system comprising:

a generally horizontal track extending generally parallel and adjacent to the wall, a generally horizontal cantilevered arm supported by the wall having a proximal end coupled to the track for movement therealong, the arm extending generally outwardly from the track, the arm including an outer tube and an inner tube that telescopes horizontally into and out of the outer tube between extended and retracted positions, and a patient flatwall coupled to a distal end of the arm rotatable relative to the arm about a first generally vertical axis, the flatwall having a plurality of service connectors, wherein the cantilevered arm moves between a retracted position and an extended position, in the retracted position the first axis is spaced less than one half the width of the patient flatwall from the wall so that the patient flatwall is blocked by the wall from rotating 90° or more relative to the cantilevered arm, in the extended position the first axis is spaced more than one half the width of the patient flatwall from the wall so that the patient flatwall is free to rotate 360° relative to the cantilevered arm.

2. The flatwall system of claim 1, wherein the patient flatwall is configured to be rotatable through at least 90° about the first generally vertical axis.

3. The flatwall system of claim 2, wherein the patient flatwall is configured to be rotatable through at least 90° about the first generally vertical axis in both clockwise and anticlockwise directions as viewed from above in a downward direction.

4. The flatwall system of claim 1, wherein the patient flatwall is configured to be rotatable through at least 180° about the first generally vertical axis.

5. The flatwall system of claim 4, wherein the patient flatwall is configured to be rotatable through at least 180° about the first generally vertical axis in both clockwise and anticlockwise directions as viewed from above in a downward direction.

6. The flatwall system of claim 1, wherein the patient flatwall includes a front and a back, the front has the plurality of service connectors, and the at least one flatwall is rotatable between a use position where the service connectors are facing away from the wall and a storage position where the service connectors are facing toward the wall.

7. The flatwall system of claim 6, wherein the back has a screen for projecting television images and the patient flatwall includes speakers for projecting television audio.

8. The flatwall system of claim 1, wherein a distance between a centerline of the track and the wall is greater than one half the width of the flatwall.

9. The flatwall system of claim 1, wherein the patient flatwall includes a front and a back, and the front and back each has a plurality of service connectors.

10. The flatwall system of claim 1, wherein the plurality of service connectors includes any one or more of the following: medical gas connectors, air connectors, negative pressure connectors, electrical power outlets, and data ports.

11. The flatwall system of claim 1, wherein the patient flatwall includes a plurality of patient care units.

12. The flatwall system of claim 11, wherein the plurality of patient care units includes any one or more of the following: infusion pumps, heart monitors, defibrillators, and equipment monitors.

13. The flatwall system of claim 1, further comprising a carriage movable along the track, wherein the arm is coupled to the carriage for movement therewith.

14. The flatwall system of claim 13, wherein the carriage includes a shaft extending downwardly therefrom, and the arm is coupled to the shaft for rotation about a second generally vertical axis.

15. The flatwall system of claim 1, wherein the track has an interior passageway through which a plurality of service lines are routed for connection to the associated service connectors.

16. The flatwall system of claim 1, wherein the arm is movable between a rotation position permitting rotation of the flatwall about the first generally vertical axis, and a stationary position not permitting the rotation of the flatwall about the first generally vertical axis.

17. The flatwall system of claim 16, wherein the arm is rotatable about a second generally vertical axis extending through the proximal end of the arm between the rotation and stationary positions.

18. The flatwall system of claim 1, wherein the outer tube has a proximal end coupled to the track for movement therealong, and the flatwall is coupled to the distal end of the inner tube for rotation about the first generally vertical axis.

19. The flatwall system of claim 1, further comprising a carriage movable along the track, wherein the proximal end of the arm is coupled to the carriage for movement therewith.

20. The flatwall system of claim 19, wherein the carriage includes a shaft extending downwardly therefrom, and the proximal end of the arm is coupled to the shaft for rotation about a second generally vertical axis.

21. The flatwall system of claim 1, wherein both the track and the arm have interior passageways through which a plurality of service lines are routed for connection to the associated service connectors.

22. The flatwall system of claim 18, wherein the arm has interior passageways through which a plurality of service lines is routed for connection to the associated service connectors.

23. The flatwall system of claim 22, wherein the system includes a drive mechanism for moving the arm along the track.

24. The flatwall system of claim 1, wherein while the cantilevered arm is in the retracted position the inner tube is substantially housed in the outer tube and the patient flatwall blocked from 90° rotation about the first axis and while the cantilevered arm is in the extended position the inner tube extends substantially out of the outer tube and the patient flatwall is free to rotate about the first axis.

25. The flatwall system of claim 6, wherein the patient flatwall houses an infusion pump with a pump surface that is generally flush with the front of the patient flatwall.

* * * * *